US007852359B2

(12) United States Patent
Evans et al.

(10) Patent No.: US 7,852,359 B2
(45) Date of Patent: Dec. 14, 2010

(54) PROTECTIVE OVERCOAT TRANSFER COMPENSATION

(75) Inventors: Stuart G. Evans, Rochester, NY (US); Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 640 days.

(21) Appl. No.: 11/931,266

(22) Filed: Oct. 31, 2007

(65) Prior Publication Data

US 2009/0111037 A1 Apr. 30, 2009

(51) Int. Cl.
*B41J 2/32* (2006.01)
*B41M 3/00* (2006.01)
*B41M 5/26* (2006.01)

(52) U.S. Cl. ..... 347/171

(58) Field of Classification Search ..... 347/171; 400/120.01

See application file for complete search history.

(56) References Cited

U.S. PATENT DOCUMENTS

| | | | |
|---|---|---|---|
| 3,556,934 | A | 1/1971 | Meyer |
| 3,779,951 | A | 12/1973 | Streu |
| 4,516,137 | A | 5/1985 | Yasui |
| 4,553,833 | A | 11/1985 | Kanaoka et al. |
| 4,621,271 | A | 11/1986 | Brownstein |
| 4,710,781 | A | 12/1987 | Stephenson |
| 4,745,413 | A | 5/1988 | Brownstein et al. |
| 4,983,991 | A | 1/1991 | Palonen |
| 4,995,741 | A | 2/1991 | Mecke et al. |
| 5,332,713 | A | 7/1994 | Oldfield et al. |
| 5,369,419 | A | 11/1994 | Stephenson et al. |
| 5,689,326 | A | 11/1997 | Yamada et al. |
| 6,092,942 | A | 7/2000 | Koichi et al. |
| 6,184,181 | B1 | 2/2001 | Lum et al. |
| 6,382,852 | B1 | 5/2002 | Koyama |
| 6,790,477 | B2 | 9/2004 | Allen et al. |
| 7,126,618 | B2 | 10/2006 | Hirumi et al. |

FOREIGN PATENT DOCUMENTS

| | | |
|---|---|---|
| EP | 1 186 438 | 3/2002 |
| EP | 1 375 184 | 1/2004 |

*Primary Examiner*—Huan H Tran
(74) *Attorney, Agent, or Firm*—Roland R. Schindler; David A. Novais

(57) ABSTRACT

Observable matte-finish indicia on a printer medium having a matte finish includes the steps creating a matte image-viewing area; creating a glossy finish region within the image-viewing area; creating indicia having a matte finish within the glossy region. The printing medium has a dye-receiving element; and the steps of controlling the specularity of the image-viewing area, the glossy region, and the indicia include the step of imagewise-heating a donor element comprising a support having thereon a laminating patch of overcoat material, the donor being in contact with the dye-receiving element to thereby thermally transfer a layer of overcoat material to the printing medium, the overcoat material layer being transferred using a predetermined energy level within the image-viewing area and the indicia in order to create a matte finish and using a different energy level within the glossy region to create a gloss finish.

13 Claims, 4 Drawing Sheets

PROTECTIVE OVERCOAT TRANSFER COMPENSATION

FIELD OF THE INVENTION

The present invention relates to the creation of unobtrusive indicia on an image-bearing medium having a matte finish by controlling the specularity of an area of the image to create a glossy region wherein matte indicia are observable to a viewer, and is particularly useful for creating such a region and indicia on an image-bearing medium onto which a dye image and a protection layer have been, or are being, thermally transferred.

BACKGROUND OF THE INVENTION

In a thermal printer, a cyan, magenta or yellow dye-donor element is placed face-to-face with a dye-receiving element. The two are then inserted between a thermal printing head and a platen roller. A linear array thermal printing head is used to apply heat from the back of the dye-donor element. The thermal printing head has many heating elements and is heated up sequentially in response to appropriate cyan, magenta or yellow electrical signals. The process is then repeated for the other two colors. Further details of this process and an apparatus for carrying it out are contained in U.S. Pat. No. 4,621,271.

Thermal prints are susceptible to retransfer of dyes to adjacent surfaces and to discoloration by fingerprints because dye is present at the dye-receiving surface of the print. Application of a protection overcoat material will practically eliminate these problems.

In a thermal dye transfer printing process, it is desirable for the finished prints to compare favorably with traditional silver-halide color photographic prints in terms of image quality. The look of the final print is very dependent on the surface texture and gloss. Typically, color photographic prints are available in surface finishes ranging from very smooth, high gloss to rough, low gloss matte. However, applying a thermal image to a rough surface would result in uniformity problems and dropouts. If a matte finish is desired on a thermal print, it has been previously been accomplished by using matte sprays or by matte surface applications through post printing processors. However, both of these solutions are costly and add a degree of complexity to the process.

Commonly assigned U.S. Pat. No. 6,184,181 discloses a process for controlling the gloss of a thermal dye transfer image by applying a protection overcoat layer on top of the transferred dye image, the protection layer being applied from an element that contains unexpanded synthetic thermoplastic polymeric microspheres. The protection layer is transferred using a predetermined energy level in order to expand the microspheres until a desired gloss level is obtained.

U.S. Pat. No. 6,092,942 relates to the formation of a silk texture shaped concave-convex pattern on a transparent cover sheet as it is transferred to the printing medium. U.S. Pat. No. 6,382,852 discloses controlling a thermal head so that a specific amount of thermal energy is applied to a recording surface. The thermal energy effects variations of glossiness corresponding to additional information to record. That is, through the application of the thermal energy, glossiness of the medium varies and the additional information is thereby recorded on the medium, and textual information such as a date and time may be recorded as additional information through the use of glossiness.

The printing of high quality black and white and multiple color images on relatively glossy print media together with identification indicia, such as alphanumeric characters or spacing marks to identify the printed image, its date of printing and other information is well known in the prior art. For example, in photography, it is known to image latent frame numbers and marks on unexposed film, as taught, for example, in U.S. Pat. No. 4,553,833. The latent image becomes visible after processing. In photographic printing, it is known to expose spacing marks along the sides of images printed on continuous rolls of photographic print media to mark the reverse surfaces of photographic prints with the date of printing. It is also known to expose areas of X-ray film with latent-alphanumeric identification characters and other information applied by thermal elements energized by microcomputer-stored image data as taught, for example, in U.S. Pat. No. 4,983,991, where the latent image characters become visible after processing the film. In thermal printing systems which effect a printing operation through heat transfer of dyes to a printing medium, it is known to print images or indicia and markings by dye transfer to the printing medium as taught, for example, by U.S. Pat. No. 4,710,781, U.S. Pat. No. 4,995,741, and U.S. Pat. No. 4,516,137. It is also known from the '137 patent to employ heat sensitive media that changes color on application of heat and pressure from the thermal elements of a printhead.

In many cases, a printer or print engine is connected to a variety of image generating sources networked together so as to allow for transmission of images from the sources to the printer or print engine. These images are received by the print engine and printed in accordance with a prioritizing scheme on an elongated element of thermally activated dye transfer printing medium. As a result of the prioritizing scheme, sets of interrelated images may be distributed out of sequence on the printed web media over a period of time. Alternatively, if the printing medium is in sheet form, the individual printed sheets may accumulate out of order in one or more bin. In either case, the operator may be required to collate the related images and distribute them to various areas or customers. It is thus desirable that the printed images be individually identifiable for such distribution. It is advantageous to the operator to have the prints labeled with indicia identifying the source, content and/or distribution, as well as the date of printing. It is also advantageous for this information to be visually apparent to the trained operator but unobtrusive in other respects.

In respect to the above-mentioned thermal printing systems, dye transfer is effected from a dye-donor element interposed between the thermal printhead elements and the printing medium in response to the applied thermal energy. Alternatively, thermally responsive print media is designed to change color upon application of minute amounts of thermal energy. In the former case, the separate dye transfer web suffers the drawbacks of the impact printer web, and in the latter case, the thermally responsive print media may be incompatible with the image bearing media.

It was therefore desirable to provide a printing system for printing unobtrusive indicia on preexisting media that is simple and relatively failsafe. Commonly assigned U.S. Pat. No. 5,369,419 discusses how such marking may be accomplished by selectively altering the given specularity so as to create alphanumeric characters or other markings that are observable by the contrast between the altered specularity and the given specularity by viewing the same with light reflected from opaque media or transmitted through transparent or semi-transparent media. Heat patterns are applied to a marking area of given specularity to effect a change in that specularity, typically from dull to highly glossy, visible to the viewer. Thus, a sheet having a low gloss, low specularity, matte surface is provided with high gloss characters. Similarly, U.S. Pat. No. 7,126,618, describes printing apparatus forms image information and information associated therewith on a print medium. The printing apparatus receives image information from an image file stored in a recording medium, etc., and obtains information associated with the image information. The associated information includes attached information that is read out from the image file based on a file format using tags via an interface unit or added information that is input or selected in accordance with the image information. The image information is printed on the print medium, and the associated information is formed on a film sheet (laminate film), which is disposed over the image-printed surface, as a watermark. The associated information is not visible when the print medium is seen from the front, and can be seen when it is seen at an angle due to the difference in surface glossiness.

Although the method and apparatus disclosed in above-described U.S. Pat. No. 5,369,419 works well for its intended purpose, it has been discovered that marking some textured surfaces with a high gloss pattern produces characters that are rather difficult to read under many lighting situations. Accordingly, it is an object of the present invention to provide a matte surface with more discernable markings.

SUMMARY OF THE INVENTION

In accordance with the above objects, it is a feature of the present invention to provide a process for creating an observable matte-finish indicia marking on a printer medium having a matte finish image-viewing area. The process includes the steps of controlling the specularity of the image-viewing area to create a matte finish for the image-viewing area; controlling the specularity of a region within the image-viewing area to create a glossy finish in the region; and controlling the specularity of indicia within the glossy region to create indicia having a matte finish within the glossy region.

In accordance with another feature of the present invention, the printing medium has a dye-receiving element; and the steps of controlling the specularity of the image-viewing area, the glossy region, and the indicia include the step of image-wise-heating a donor element comprising a support having thereon a laminating patch of overcoat material, the donor being in contact with the dye-receiving element to thereby thermally transfer a layer of overcoat material to the printing medium, the overcoat material layer being transferred using a predetermined energy level within the overall area and the indicia in order to create a matte finish and using a different energy level within the viewing region to create a gloss finish.

DETAILED DESCRIPTION OF THE INVENTION

Figure 1:
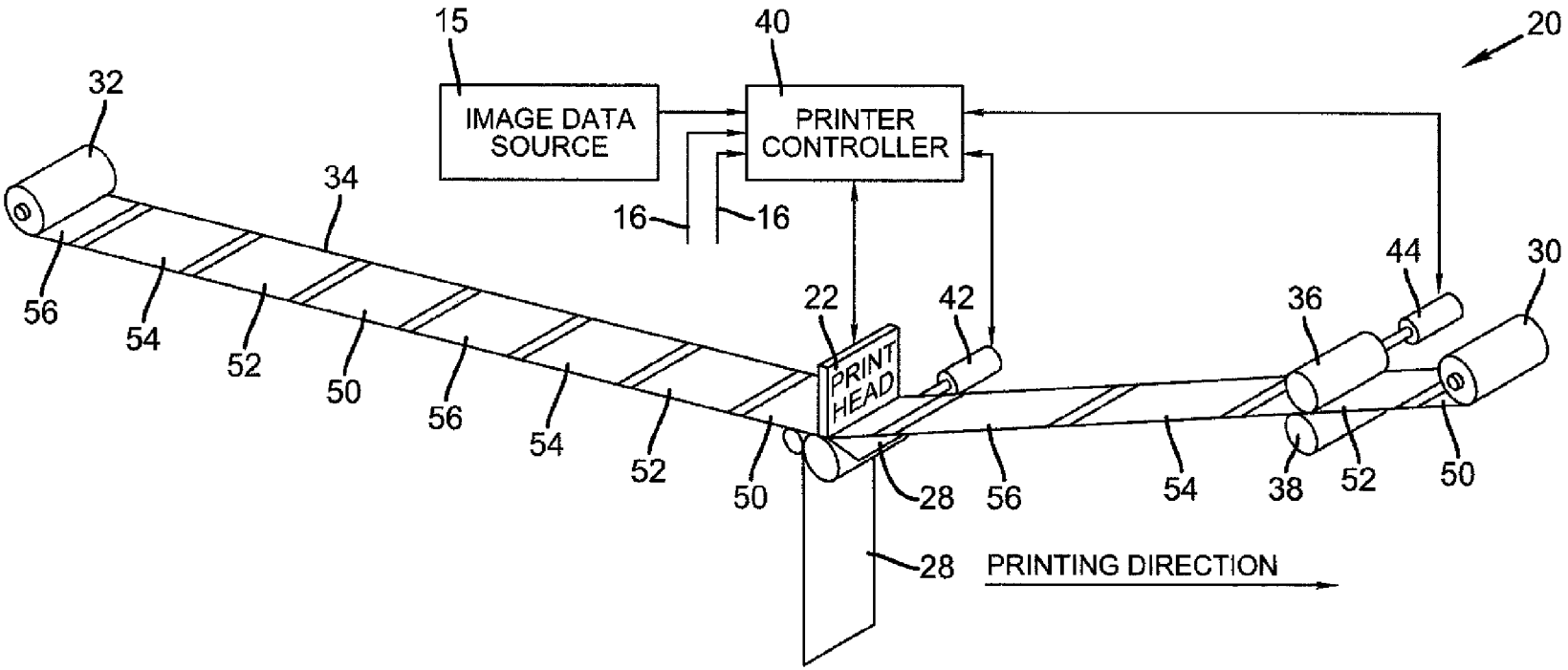
FIG. 1 PRIOR ART
FIG. 1 is a schematic view of a thermal printer as known in the prior art.

As is generally known and as used herein, a typical dye-donor element is used in a thermal printer 20 having a printhead 22 with a series of heating elements arranged in a row directed in the main-scan direction of printing, a transport platen roller 24 and a clamping roller 26 for transporting a printing medium 28, a take-up spool 30, and a supply spool 32 for a dye-donor element 34, a drive roller 36 and the clamping roller 38 for the dye-donor element 34, a printer controller 40, and first and second motors 42 and 44, respectively. Motor 42 is a conventional stepper motor and motor 44 is a conventionally controlled torque motor. The printer controller receives an image data signal from a conventional digital image data source 15, such as a computer, workstation, digital camera or other source of digital data, and generates instructions for printhead 22 in response to the image data. Additionally, printer controller 40 has inputs 16 for receiving signals from various conventional detectors (not shown) in thermal printer 20 which provide routine administrative information, such as a position of printing medium 28, a position of dye-donor element 34, the beginning and end of a print cycle, etc. Printer controller 40 generates operating signals for motors 42 and 44 in response to said information.

The printing medium and dye-donor element are moved incrementally, line-by-line, in the slow-scan direction during printing. Dye-donor element 34 is comprised of a repeating series of dye patches coated on a clear film of polyethylene terephthalate. The element includes a repeating series of three different primary color sections or patches such as a yellow dye patch 50, a magenta dye patch 52 and a cyan dye patch 54 followed by a transparent laminating patch 56 after the cyan dye patch.

To make a color image using a thermal printer, respective color dyes in a single series of yellow, magenta and cyan dye patches on dye-donor element 34 are successively heat-transferred (e.g. by diffusion or sublimation), one on top of the other, onto an image receiving surface of printing medium 28. Then the transparent laminating section is deposited on the color image print. The dye transfer from each color section to the printing medium is done one line of pixels at a time across the color section via a bead of selectively used heating or resistor elements on thermal printhead 22. The bead of heating elements makes line contact across the entire width of dye-donor element 34, but only those heating elements that are actually used for a particular line are heated sufficiently to effect a color dye transfer to printing medium 28. The temperature to which the heating element is heated is proportional to the density (darkness) level of the corresponding pixel formed on the printing medium. Greater temperature of the heating element produces greater the density level (or at least color dye transfer for that color) of the corresponding pixel. Various modes for increasing the temperature of the heating element are described in prior art U.S. Pat. No. 4,745,413 issued May 17, 1988.

During the color print-making process, dye-donor element 34 and the printing medium 28 are advanced in unison, with yellow dye patch 50 moving in contact with the printing medium longitudinally over a stationary bead of heating elements in order to effect the line-by-line yellow dye transfer from the yellow color dye patch. Take-up spool 30 draws the dye-donor element forward over the bead of heating elements, and drive and clamping rollers 36 and 38, respectively, drive the printing medium forward over the bead of heating elements. Transport platen roller 24 holds the printing medium in a dye receiving relation with the dye-donor element at the bead of heating elements.

Once the yellow dye transfer is completed, transport platen roller 24 is retracted from adjacent the printhead (or alternatively the printhead is moved away from the platen roller) to allow drive and clamping rollers 36 and 38, respectively, to return the printing medium rearward in preparation for a second pass over the bead of heating elements. Then, platen roller 24 is returned to adjacent the printhead, and dye-donor element 34 and printing medium 28 are advanced forward in unison, with a magenta dye patch 52 of the dye-donor element 34 moving in contact with printing medium 28 longitudinally over the bead of heating elements in order to a effect a line-by-line magenta dye transfer from the magenta dye patch to the printing medium. The magenta dye transfer to the printing medium is in exactly the same area on the printing medium as was subject to the yellow dye transfer and at pixel locations corresponding to where magenta dye is to be transferred to the printing medium. In many instances, magenta dye will be deposited directly over the yellow dye at certain pixel locations as is well known for creating different colors.

Once the magenta dye transfer is completed, transport platen roller 24 is retracted from adjacent printhead 22 to allow drive and clamping rollers 36 and 38, respectively, to return printing medium 28 rearward in preparation for a third pass over the bead of heating elements. Then, the platen roller is returned to adjacent the printhead, and dye-donor element 34 and the printing medium are advanced forward in unison, with a cyan dye patch 54 of the dye-donor element moving in contact with the printing medium longitudinally over the bead of heating elements in order to effect a line-by-line cyan dye transfer from the cyan dye patch to the printing medium. The cyan dye transfer to the printing medium is in exactly the same area on the printing medium as was subjected to the yellow and magenta dye transfers and at pixel locations corresponding to where cyan dye is to be transferred to the printing medium. In many instances, cyan dye will be deposited directly over the yellow dye, the magenta dye or on pixel locations that include both the yellow dye and magenta dye at certain pixel locations as is well known for creating different colors.

When the cyan dye transfer is completed, platen roller 24 is retracted from adjacent the printhead to allow the pair of clamping and drive rollers to return the printing medium rearward in preparation for a fourth pass over the bead of heating elements. Then, the platen roller is returned to adjacent the printhead, and the dye-donor element and the printing medium are advanced forward in unison, with the transparent laminating section of the dye-donor element moving in contact with the printing medium longitudinally over the bead of heating elements in order to effect a line-by-line transfer of transparent overcoat material to the printing medium from a laminating patch 56 on dye-donor element 34.

After the fourth pass, the platen roller is retracted from adjacent the printhead to allow the printing medium to be returned rearward in preparation for exiting the printer. Then, clamping roller 26 and transport platen roller 24 advance the printing medium to an exit tray.

Printhead 22 performs a printing operation by selectively heating and thereby transferring spots of dye from dye-donor element 34 onto printing medium 28. The system of dye deposition in thermal printing is well known in the prior art and an example is provided in the description above. The creation of a full-color image requires the deposition of three separate images superimposed on each other, using yellow, magenta and cyan dyes successively from a predetermined dye triad.

In the illustrated preferred embodiment of the invention, the dye-donor element employed in the process of the invention is a multicolor element comprising repeating color patches of yellow, magenta and cyan image dyes, respectively, dispersed in a binder, and a patch containing the overcoat material. In another embodiment of the invention, the overcoat material is the only layer on the donor element employed and is used in conjunction with another dye-donor element that contains the image dyes. In still another embodiment of the invention, the dye-donor element employed is a monochrome element and comprises repeating units of two areas, the first area comprising a layer of one image dye dispersed in a binder, and the second area comprising the overcoat material. In yet another embodiment of the invention, the dye-donor element employed is a black-and-white element and comprises repeating units of two areas, the first area comprising a layer of a mixture of image dyes dispersed in a binder to produce a neutral color, and the second area comprising the overcoat material.

However, in other embodiments, the laminate material, yellow, magenta, and cyan dyes, can be supplied by individual donor ribbons and which can be printed using a printer with multiple print heads. An example of such a printer is the ML-500 printer sold by Eastman Kodak Company, Rochester, N.Y., U.S.A.

Printer 20 can be programmed to provide a given energy level during transfer of the transparent overcoat material from laminating patch 56. This energy level will correspond to a desired gloss level in the final print without changing the dye-donor element or the printing medium. In general, the minimum energy level for transferring the overcoat material is at least about 2.4 joules/cm$^2$. A preferred range for the energy level is from about 2.4 joules/cm$^2$ to about 3.6 joules/cm$^2$.

In one embodiment, the overcoat material can optionally contain unexpanded synthetic thermoplastic polymeric microspheres that expand during transfer until a desired gloss level is obtained. Any expandable microspheres may be used in the invention such as those disclosed in U.S. Pat. No. 3,556,934 and No. 3,779,951. In a preferred embodiment of the invention, the expandable microspheres are white, spherically formed, hollow particles of a thermoplastic shell encapsulating a low-boiling, vaporizable substance core, such as a gas, which acts as a blowing agent. When the unexpanded microspheres are heated, the thermoplastic shell softens and the encapsulated blowing agent expands, building pressure. This results in expansion of the microspheres. Unexpanded microspheres have an initial average diameter of 6 μm to 35 μm (based on weight average) depending on grade. After expansion they reach average diameters of 20 μm to 120 μm.

The expandable microspheres employed in this embodiment may be formed by encapsulating propane, butane or any other low-boiling, vaporizable substance into a microcapsule of a thermoplastic resin such as a vinylidene chloride-acrylonitrile copolymer, a methacrylic acid ester-acrylonitrile copolymer or a vinylidene chloride-acrylic acid ester copolymer. These microspheres are available commercially as Expancel® Microspheres 551 DU, 461 DU, 551-20 DU and 461-20 DU (Expancel Inc.). The amount of the microspheres employed in the invention ranges from about 10% to about 200% by weight of the polymer used in the protection layer. This coverage is from about 0.05 g/m$^2$ to about 1 g/m$^2$, preferably about 0.25 g/m$^2$ to about 0.5 g/m$^2$.

Where this is done, a protection overcoat material layer can be provided on a thermal print by uniform application of heat using a thermal head. After transfer to the thermal print, the protection layer provides superior protection against image deterioration due to exposure to light, common chemicals, such as grease and oil from fingerprints, and plasticizers from film album pages or sleeves made of poly(vinyl chloride). The protection layer is generally applied at coverage of at least about 0.05 g/m$^2$.

The transferable protection layer may comprise the microspheres dispersed in a polymeric binder. Many such polymeric binders have been previously disclosed for use in protection layers. Examples of such binders include those materials disclosed in U.S. Pat. No. 5,332,713.

The overcoat material is printed on the receiving element at a set head voltage and the energy used to do the lamination is determined by the time the heating elements of the print head are turned on, which in turn is modulated by the number of pulses and it's enable width. The energy was calculated according to the following equation $E=PE_{na}NHL/A$ where:

E=Energy joules/cm$^2$)

P=Power=$V^2/R$ $E_{na}$=Enable Width (seconds)

N=Number of Pulses

H=Number of Heating Elements

L=Number of Lines to Print

A=Printed Area (cm$^2$)

The surface gloss of each print can be measured with a Gardner Micro-Tri-Gloss meter according to the ASTM Standard Test Method for Specular Gloss (D 523-89). Surface roughness and peaks per centimeter measurements are made by the ANSI/ASME B46.1-1985 test on page 30, Sect. C3.1.1, described in the "1985 Catalog of American National Standards", published by the American Society of Mechanical Engineers jointly with the American National Standards Institute); United Engineering Center, 345 E. 47th Street, New York, N.Y. 10017. The definition for Ra (Roughness average) and um-AA (Arithmetic Average) is also described in the above article. The following results have been experimentally obtained:

TABLE

| Element | Printing Energy (joules/cm$^2$) | 60 degree gloss | Roughness Average (Ra) (μm) | Peaks/cm (1 μm) |
|---|---|---|---|---|
| Control 1 | 1.986 | 76.6 | 0.11 | 1 |
| Control 1 | 2.483 | 77.0 | 0.10 | 0 |
| Control 1 | 2.979 | 76.7 | 0.10 | 0 |
| Control 1 | 3.476 | 74.5 | 0.11 | 3 |
| 1 | 1.986 | 74.9 | 0.18 | 18 |
| 1 | 2.483 | 70.0 | 0.20 | 19 |
| 1 | 2.979 | 62.3 | 0.30 | 46 |
| 1 | 3.476 | 52.5 | 0.50 | 78 |
| 2 | 1.986 | 75.0 | 0.16 | 5 |
| 2 | 2.483 | 66.6 | 0.23 | 21 |
| 2 | 2.979 | 59.4 | 0.32 | 65 |
| 2 | 3.476 | 37.1 | 0.51 | 120 |
| 3 | 1.986 | 72.6 | 0.15 | 5 |
| 3 | 2.483 | 67.4 | 0.19 | 16 |
| 3 | 2.979 | 59.5 | 0.25 | 49 |
| 3 | 3.476 | 41.0 | 0.45 | 103 |
| 4 | 1.986 | 68.4 | 0.22 | 23 |
| 4 | 2.483 | 58.7 | 0.29 | 40 |
| 4 | 2.979 | 49.8 | 0.37 | 81 |
| 4 | 3.476 | 33.1 | 0.58 | 130 |

The above results show that the elements enable one to provide a range of gloss levels in a final print that is dependent upon the energy supplied from the print head to the protection layer during transfer. As the roughness average and peaks/cm increase, the gloss level decreases.

These experiments establish that a thermal printhead can provide marking data or indicia on a variety of image bearing media by changing the specularity of the surface in the manner described above.

Figure 2:
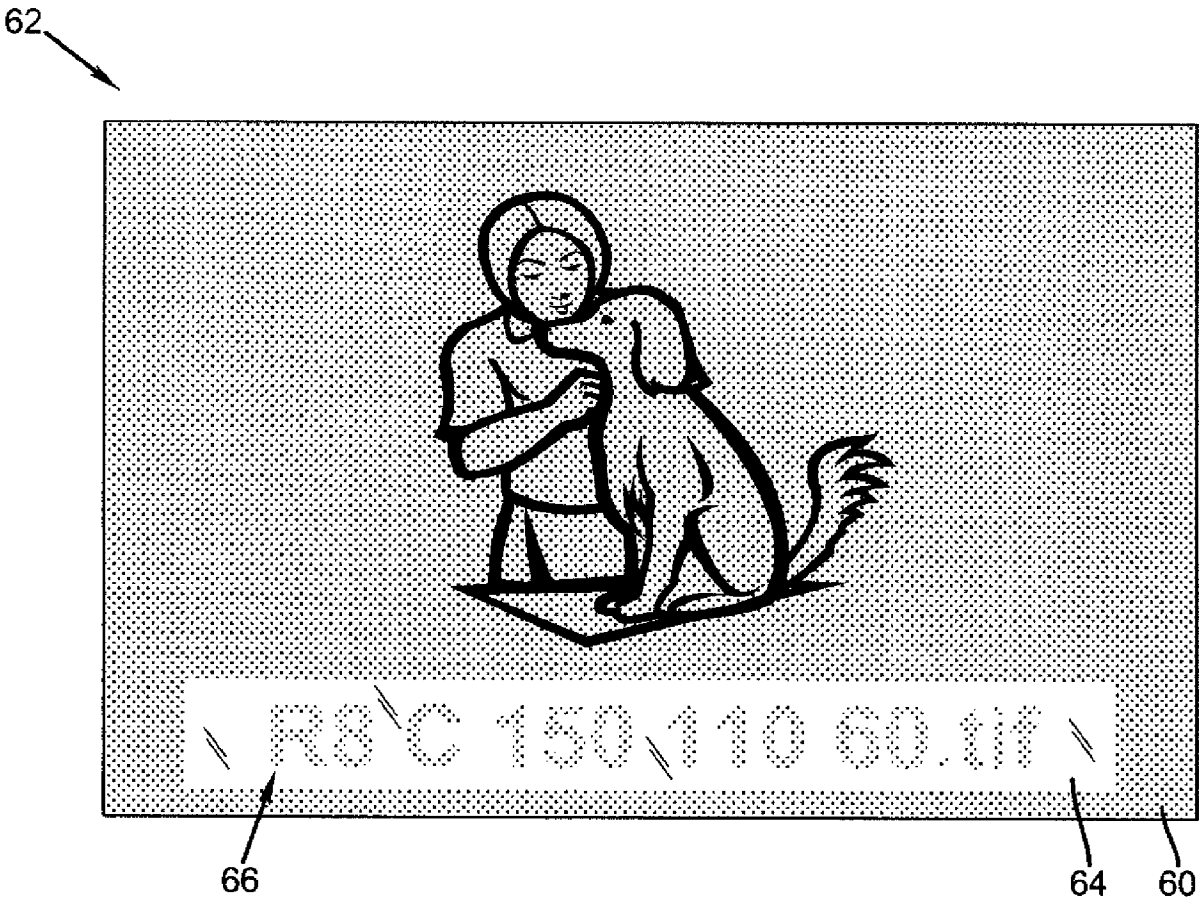
FIG. 2 is an illustration of matte indicia on a glossy viewing region of an overall matte finish area according to the present invention.

Referring to FIG. 2, the above-described process is used to create a matte finish on an image-viewing area 60 of the image-bearing surface of a document 62. Preferably during laminate lay down, a glossy region 64 is created in, say, a marginal portion of the document where it is unlikely to be in a region of high interest to a typical observer. The gloss finish in area 64 is produced by a using lower energy level than that used for the matte finish area 60 and indicia 66. In the embodiment that is illustrated in FIG. 2, a common higher energy level is used to create matte finish area 60 and indicia 66.

The above-described process is used to create markings or indicia 66 having a matte finish within glossy region 64.

Figure 3:
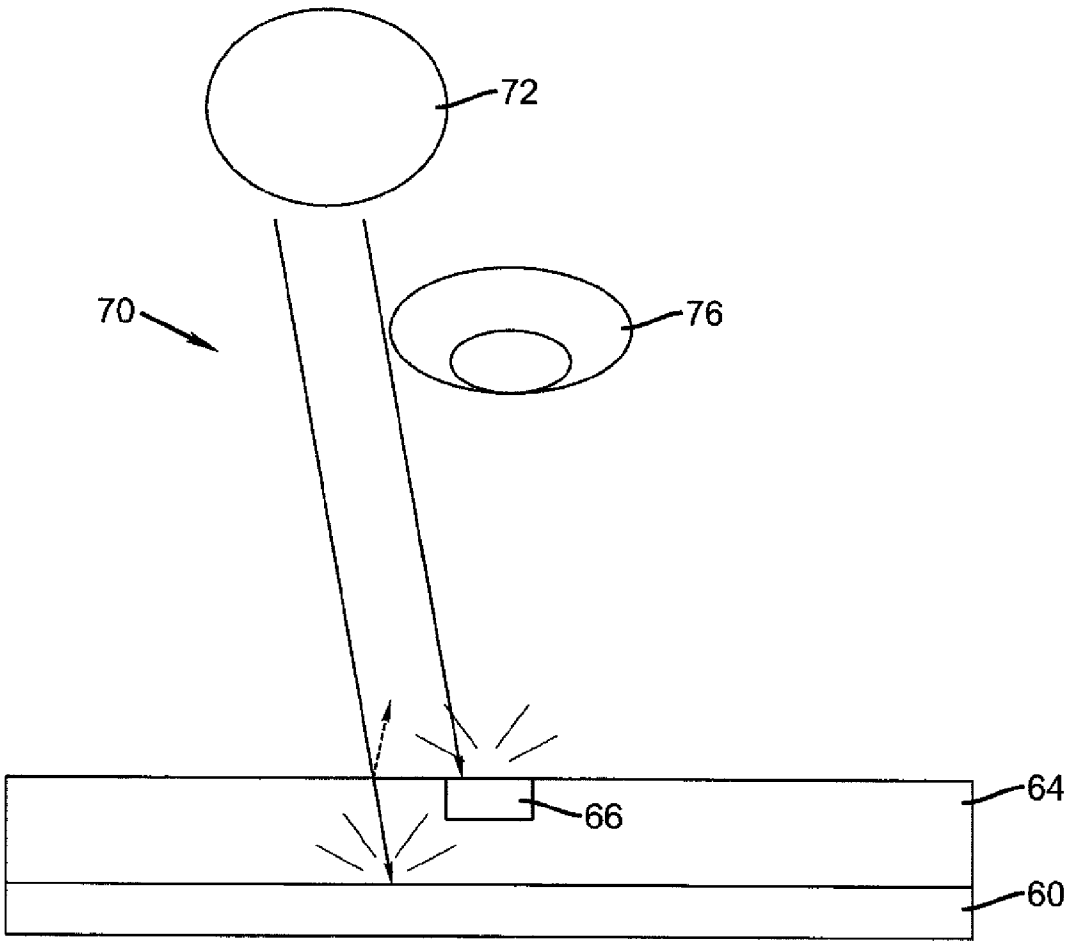
FIG. 3 is an illustration of light reflecting from an image area, matte indicia and glossy regions at one angle.

As is shown in FIG. 3, light 70 from a source 72 passes to an eye 76 of an observer within certain fields of view subject to non-specular reflection from the a source image within image viewing area 60, while light that is subject to non-specular reflection by the deglossed indicia 66. Thus, when viewed within the illustrated viewing position and a range of related viewing positions, the indicia 66 are unobtrusive to the typical observer who would not be looking for the marking 66 but which, by their difference in specularity from region 64, are visually apparent to a trained observer.

Figure 4:
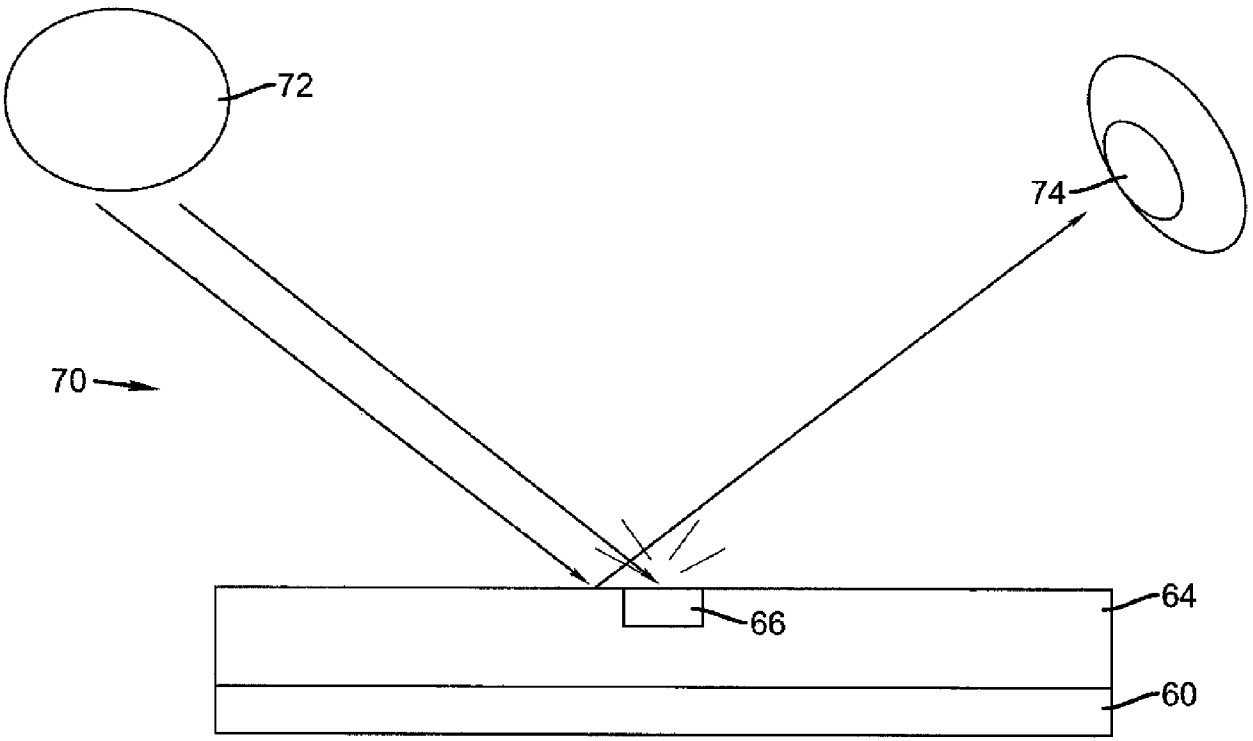
FIG. 4 is an illustration of light reflecting from an image area, matte indicia and glossy regions at a different angle than the angle depicted in FIG. 3.

However as is illustrated in FIG. 4, when the angular relationship between light source 72, image viewing area 60 and eye 72 is greater, a greater percentage of the light 70 that strikes glossy regions 64 is reflected in a specular manner to eye 76. However, deglossed indicia 66 continues to reflect light in a generally non-specular manner. This creates a contrast difference that is more readily apparent to both trained and untrained observers.

The invention has been described in detail with particular reference to certain preferred embodiments thereof, but it will be understood that variations and modifications can be effected within the spirit and scope of the invention.

PARTS LIST

15 image data source
16 inputs
20 thermal printer
22 printhead
24 transport platen roller
26 clamping roller
28 printing medium
30 take up spool
32 supply spool
34 dye-donor element
36 drive roller
38 clamping roller
40 printer controller
42 stepper motor
44 controlled torque motor
50 yellow dye patch
52 magenta dye patch
54 cyan dye patch
56 laminating patch of overcoat material
60 image-viewing area
62 document
64 glossy region
66 matte finish indicia
70 light
72 light source
76 eye

The invention claimed is:

1. A process for creating an observable matte-finish indicia marking on a printer medium having a matte finish image-viewing area, said process comprising the steps of:

controlling the specularity of the image-viewing area to create a matte finish for the image-viewing area;

controlling the specularity of a region within the image-viewing area to create a glossy finish in the region; and controlling the specularity of indicia within the glossy region to create indicia having a matte finish within the glossy region.

2. A process for creating an observable matte-finish indicia marking as set forth in claim 1, wherein:

the printing medium has a dye-receiving element; and the steps of controlling the specularity of the image-viewing area, the glossy region, and the indicia include the step of imagewise-heating a donor element comprising a support having thereon a laminating patch of overcoat material, said donor being in contact with the dye-receiving element, thereby thermally transferring a layer of overcoat material to the printing medium, said overcoat material layer being transferred using a predetermined energy level within the image-viewing area and the indicia in order to create a matte finish and using a different energy level within the glossy region to create a gloss finish.

3. A process for creating an observable matte-finish indicia marking as set forth in claim 2, wherein the predetermined energy level used to create a matte finish is lower than the different energy level used to create a gloss finish.

4. A process for creating an observable matte-finish indicia marking as set forth in claim 2, wherein the predetermined energy level used to create a matte finish is higher than the different energy level used to create a gloss finish.

5. A process for creating an observable matte-finish indicia marking as set forth in claim 2, wherein:

said overcoat material contains unexpanded synthetic thermoplastic polymeric microspheres having a particle size in the unexpanded condition of from about 5 to about 20 μm; and said microspheres expand upon the application of heat energy.

6. A process for creating an observable matte-finish indicia marking as set forth in claim 2, wherein said energy level is at least about 2.4 joules/$cm^2$.

7. A process for creating an observable matte-finish indicia marking as set forth in claim 2, wherein said energy level is from about 2.4 joules/$cm^2$ to about 3.6 joules/$cm^2$.

8. A process for creating an observable matte-finish indicia marking as set forth in claim 2, wherein said microspheres are present at coverage of about 0.05 g/$m^2$ to about 1 g/$m^2$.

9. A process for creating an observable matte-finish indicia marking as set forth in claim 2, wherein said microspheres comprise a vinylidene chloride-acrylonitrile copolymer, a methacrylic acid ester-acrylonitrile copolymer, or a vinylidene chloride-acrylic acid ester copolymer.

10. A process for creating an observable matte-finish indicia marking as set forth in claim 2, wherein said microspheres comprise an outer shell of a vinylidene chloride-acrylonitrile copolymer, a methacrylic acid ester-acrylonitrile copolymer or a vinylidene chloride-acrylic acid ester copolymer, and a core of a low boiling, vaporizable substance.

11. A process for creating an observable matte-finish indicia marking as set forth in claim 2, wherein said donor element is a multicolor element comprising repeating color patches of yellow, magenta and cyan image dyes, respectively, dispersed in a binder, and a patch containing said overcoat material.

12. A process for creating an observable matte-finish indicia marking as set forth in claim 2, wherein said overcoat material is transparent.

13. A process for creating an observable matte-finish indicia as set forth in claim 2, wherein said matte finish is obtained at least in part by varying the energy level used to transfer the laminate.

* * * * *